US006829786B2

(12) United States Patent
Ellis

(10) Patent No.: US 6,829,786 B2
(45) Date of Patent: Dec. 14, 2004

(54) BELT CONCEALING DEVICE

(75) Inventor: Lavandis L. Ellis, Chicago, IL (US)

(73) Assignee: Lavandis Ellis, Chicago, IL (US)

( * ) Notice: Subject to any disclaimer, the term of this patent is extended or adjusted under 35 U.S.C. 154(b) by 0 days.

(21) Appl. No.: 10/702,169

(22) Filed: Nov. 5, 2003

(65) Prior Publication Data

US 2004/0107480 A1 Jun. 10, 2004

Related U.S. Application Data

(63) Continuation of application No. 10/310,737, filed on Dec. 5, 2002, now abandoned.

(51) Int. Cl.[7] ..... A41D 13/02
(52) U.S. Cl. ..... 2/235
(58) Field of Search ..... 2/238, 228, 67, 2/82, 69, 79, 222, 235–237, 223, 227, 400, 401, 403, 406

(56) References Cited

U.S. PATENT DOCUMENTS

| | | | | |
|---|---|---|---|---|
| 1,998,865 A | | 4/1935 | Fekete | |
| 2,885,685 A | | 5/1959 | Carr | |
| 3,748,699 A | | 7/1973 | Cunningham | |
| 3,793,645 A | | 2/1974 | Kadison | |
| 4,607,396 A | * | 8/1986 | Craig | 2/79 |
| 5,983,403 A | | 11/1999 | Neeley | |
| 6,665,882 B1 | * | 12/2003 | Pedrick | 2/228 |

* cited by examiner

*Primary Examiner*—Tejash Patel

(57) ABSTRACT

Disclosed is a device for use in concealing a belt used to secure the pants. The device includes a liner fastened to the pants waist and cooperatively defining a continuous channel with the pants waist. One end of the liner overlaps the other end of the liner and is releasably fastened thereto, concealing the belt from view behind the liner.

9 Claims, 1 Drawing Sheet

BELT CONCEALING DEVICE

CROSS-REFERENCE TO RELATED APPLICATIONS

This application is a continuation in part of application Ser. No. 10/310,737 filed Dec. 5, 2002 now abandoned.

INCORPORATION BY REFERENCE

This application incorporates by reference co-pending application Ser. No. 10/310,737 filed Dec. 5, 2002.

FIELD OF THE INVENTION

This invention relates to an improved method and apparatus for fastening the waist of pants and shorts.

BACKGROUND OF THE INVENTION

There have been many attempts to create a smooth clothing appearance. In particular there has been a long felt but unmet desire to streamline the appearance of a user's pant's waist. Prior attempts have included the use of an elastic waist band, and an adjustable waist. None of the prior attempts is entirely satisfactory. The present invention addresses this need by providing a way to completely conceal a conventional belt and belt buckle.

It is an object of the invention to provide an apparatus which enables a user to use a conventional belt to secure his or her pants while completely concealing the belt from view.

SUMMARY OF THE INVENTION

Disclosed is a device for use in concealing a belt used to secure the pants. The device includes a liner fastened to the pants waist and cooperatively defining a continuous channel with the pants waist. One end of the liner overlaps the other end of the liner and is releasably fastened thereto, concealing the belt from view behind the liner.

According to a further aspect of the invention, a first tongue and first flap are provided on one end of the liner in a spaced apart relationship, and a second flap and a second tongue are provided on the other end of the liner in a spaced apart relationship. The second tongue overlaps the first flap is releasably secured thereto by the fastening means, and the first tongue overlaps the second flap is releasably secured thereto by the fastening means.

According to another aspect of the invention, the fastening means is one of a snap and a hook and loop material.

According to another aspect of the invention a fabric layer is attached to an exposed surface of the liner, concealing the liner from view.

According to another aspect of the invention the belt concealing device includes two liners, the first liner being attached to the pants waist and the second liner being attached to and cooperatively defining a continuous channel with the first liner. One end of the second liner overlaps the other of end of the second liner, concealing the belt is concealed from view.

The above-noted features and advantages of the present invention, as well as additional features and advantages, will be readily apparent to those skilled in the art upon reference to the following detailed description and the accompanying drawings.

DETAILED DESCRIPTION OF THE PREFERRED EMBODIMENTS

Conventional pants and shorts are provided with a plurality of evenly spaced belt-loops through which a belt is threaded. Tightening of the belt help ensures that the pants or shorts remain in place on the user's waist or hips. While portions of the belt are concealed behind the belt loops, the vast majority of the belt is visible. Moreover, the belt closure or belt buckle is visible in the front.

Figure 1:
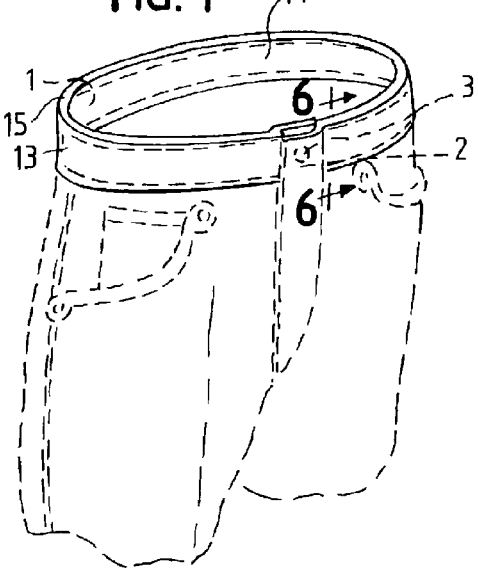
FIG. 1 is an enlarged plan view of a belt concealing device according to the present invention.
Figure 2:
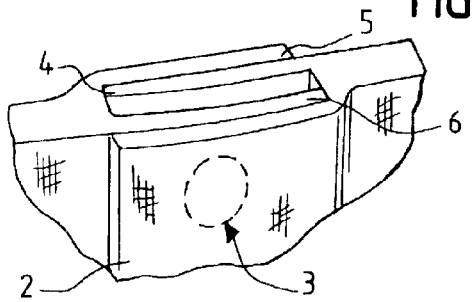
FIG. 2 is a sectional perspective view of the belt concealing device of FIG. 1.

FIG. 1 is an enlarged plan view of a belt concealing apparatus 1 according to the present invention provided on a pants waist 14. FIG. 2 is a sectional perspective view of the belt-concealing apparatus 1 of FIG. 1.

According to a first embodiment of the invention, the belt concealing apparatus 1 includes a liner 10 which is attached to the waist 14 of a conventional pair of pants. Preferably the belt-concealing apparatus 1 is stitched to the pants waist. However, one of ordinary skill in the art will appreciate that other methods may be used to attach the belt concealing apparatus 1 to the pants waist 14.

The liner 10 is preferably formed of a flexible material such as plastic which will conform to the shape of the user's waist. One of ordinary skill in the art will appreciate that the liner may be formed of other materials including fabric.

An optional fabric layer 17 may be attached to the liner 10 by stitching or the like.

Figure 5:
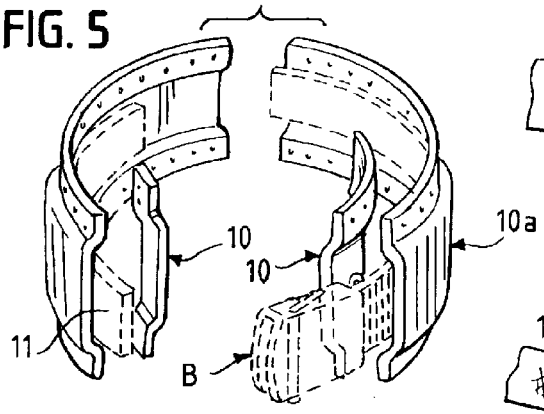
FIG. 5 is an exploded perspective view of the inside channel defined by the belt concealing device with a belt illustration for operational purpose.

The liner 10 cooperatively defines a continuous channel 15 with an exterior surface 13 of the pants waist 14. FIG. 5 is an exploded perspective view of the belt concealing apparatus 1 showing the continuous channel 15 with a belt 11 shown in phantom. The width of the liner 10 is selected to ensure that the continuous channel 15 is capable of accommodating a conventional belt 11. See FIGS. 1 and 5.

FIG. 5 further illustrates an optional liner backer 10A. The liner backer 10A is interposed between the liner 10 and the pants waist 14 to provide additional rigidity to the belt concealing apparatus 1. In the embodiment depicted in FIG. 5 the liner backer 10A is provided proximate both ends of the liner 10 such that the channel 15 is defined in portions cooperatively by the liner 10 and liner backer 10A and in portions by the liner 10 and the exterior surface 13 of the pants waist 14. However, the liner backer 10A may be provided as a continuous unit such that the channel 15 is defined cooperatively by the liner 10 and liner backer 10A.

Figure 3:
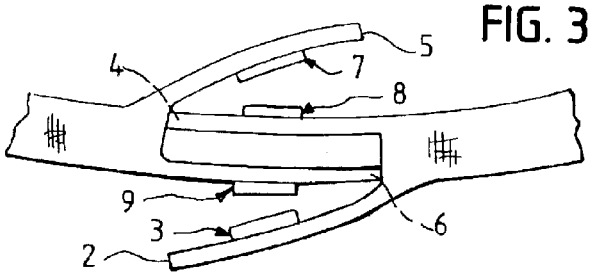
FIG. 3 is a top sectional view of pants waist, showing a double flap while opened.
Figure 4:
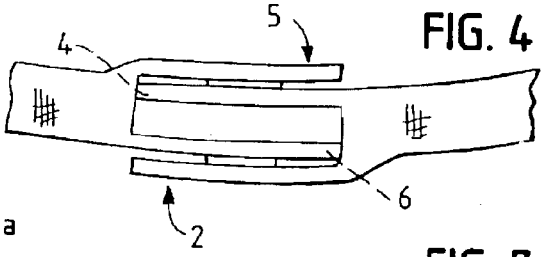
FIG. 4 is a top sectional view of pants waist, showing a double flap while closed.
Figure 7:
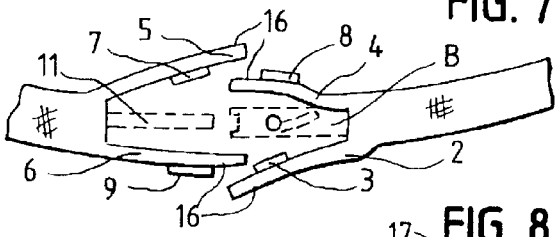
FIG. 7 is a top plan sectional view of the front pants waist, showing the proper procedure on how to fasten the double flaps of the belt concealing device.
Figure 6:
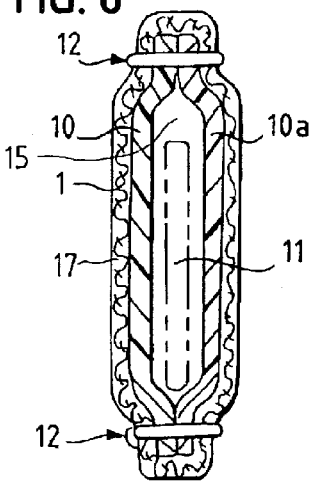
FIG. 6 is a cutaway sectional view of the belt concealing device, the opposite side being the mirror image.
Figure 8:
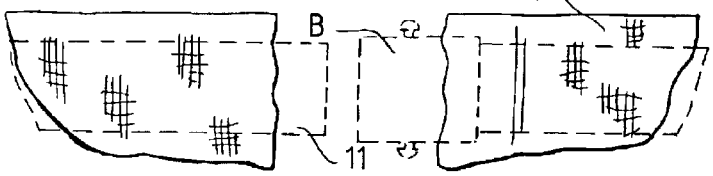
FIG. 8 is a front elevation sectional view, showing the outer layer of the continuous belt-loop pants waist opened, with a belt illustrated for operational purpose.
Figure 9:
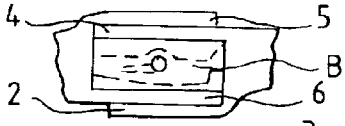
FIG. 9 is a top sectional view of the double flaps closed, with a belt-buckle illustration.
Figure 10:
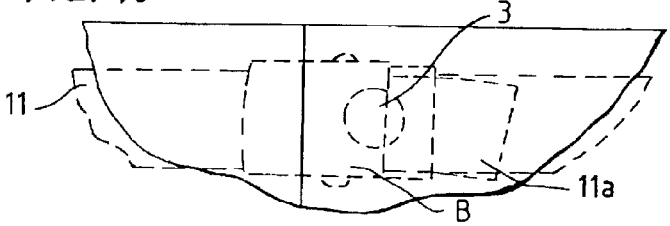
FIG. 10 is a front elevation sectional view, showing an illustration of a belt being concealed behind the double flaps, as if the front flaps were fastened.

As seen in FIGS. 5–10 a buckle concealer 16 attached to the liner 10 conceals the buckle B from view. In the embodiment depicted in FIGS. 3 and 4, the buckle concealer 16 includes a pair of flaps 2 and 5 and a pair of tongues 4 and 6. However, one of ordinary skill in the art will appreciate that the buckle concealer 16 could simply include one flap 2 or 5 overlapping the other flap 5 or 2. FIG. 3 is a top sectional view of pants waist 14, showing flaps 2 and 5 in an open position. FIG. 4 is a top sectional view of pants waist 14, showing flaps 2 and 5 in a closed position.

The liner 10 and optional liner backer 10A are formed of flexible material such as plastic or fabric. In the embodiment depicted in FIG. 5, the liner 10 is former of an injection molded plastic material and a decorative fabric layer 17 is attached to the liner 10 by stitching 12, adhesive or the like.

As best seen in FIG. 3, fasteners 7 and 8 secure the flap 5 to tongue 4 of the liner 10, and fasteners 3 and 9 secure the flap 2 to tongue 6 of the liner 10.

According to a preferred embodiment, fasteners 3, 7, 8, 9 are snaps. However, other fasteners such as hook and loop material or the like may be used to fasten the flaps 2 and 5.

In operation, the user fastens fasteners 7 and 8, threads a belt 11 through the continuous channel 15 defined by the liner 10 and pants waist 14, and buckles the belt buckle B. Excess belt 11*a* is tucked inside the channel 15 and behind Flap 2 and tongue 6. Next the user fastens fasteners 3 and 9, securing the flap 2 to tongue 6 of the liner 10 and completely concealing the belt 11 and belt buckle B.

As will be appreciated by one of ordinary skill in the art, in a single flap embodiment, the flap 5, tongue 4 and fasteners 7 and 8 are omitted. In a one flap embodiment, the user threads a belt 11 through the continuous channel 15 defined by the liner 10 and pants waist 14, and buckles the belt buckle B. Next the user fastens fasteners 3 and 9, securing the flap 2 to tongue 6 of the liner 10 and completely concealing the belt 11 and belt buckle B.

The foregoing description of the invention is illustrative only, and is not intended to limit the scope of the invention to the precise terms set forth. Further, although the invention has been described in detail with reference to certain illustrative embodiments, variations and modifications exist within the scope and spirit of the invention as described and defined in the following claims.

I claim:

1. Pants having an integral device for concealing a belt used to secure the pants, comprising:

pants having a waist at one end;

a liner fastened to the pants waist and cooperatively defining a continuous channel with the pants waist, said liner having first and second ends, one of said first and second ends overlapping the other of said first and second ends; and means for releasably fastening the overlapping portions of said liner;

wherein the belt is concealed from view behind said liner.

2. The pants according to claim 1, further comprising:

a first flap and a first tongue formed on said first end of said liner in a spaced apart relationship;

a second flap and a second tongue formed on said second end of said liner in a spaced apart relationship;

said second tongue overlaps said first flap is releasably secured thereto by said fastening means; and said first tongue overlaps said second flap is releasably secured thereto by said fastening means.

3. The pants according to claim 1, wherein said fastening means is one of a snap and a hook and loop material.

4. The pants according to claim 1 further comprising a fabric layer attached to an exposed surface of said liner and concealing the liner from view.

5. Pants having an integral device for concealing a belt used to secure the pants, comprising:

pants having a waist;

a first liner having first and second ends, said first liner being attached to the pants waist;

a second liner having first and second ends, said second liner being attached to and cooperatively defining a continuous channel with the first liner;

one of said first and second ends of said second liner overlapping the other of said first and second ends of said second liner; and means for releasably fastening the overlapping portions of said second liner;

wherein the belt is concealed from view behind said second liner.

6. The pants according to claim 5, further comprising:

a first flap and a first tongue formed on said first end of said second liner in a spaced apart relationship;

a second flap and a second tongue formed on said second end of said second liner in a spaced apart relationship;

said second tongue overlaps said first flap and is releasably secured thereto by said fastening means; and said first tongue overlaps said second flap and is releasably secured thereto by said fastening means.

7. The pants according to claim 5, wherein said fastening means is one of a snap and a hook and loop material.

8. The pants according to claim 5 further comprising a fabric layer attached to an exposed surface of said second liner and concealing the second liner from view.

9. A method for concealing a belt used to secure a user's pants waist, comprising:

providing a pair of pants having a waist;

providing a liner on said pants waist, said liner cooperatively defining a continuous channel with said pants waist, wherein one end of said liner overlaps an opposing end of said liner;

threading the belt through the continuous channel; and releasably fastening the overlapping portions of said liner, concealing the belt from view behind said liner.

* * * * *